United States Patent [19]

Boiko et al.

[11] Patent Number: 4,587,999

[45] Date of Patent: May 13, 1986

[54] PROCESS FOR THE PRODUCTION OF A BALL POINT PEN CARTRIDGE

[75] Inventors: Rudolf Boiko; Günter Ulrich, both of Hanover, Fed. Rep. of Germany

[73] Assignee: Pelikan AG, Hanover, Fed. Rep. of Germany

[21] Appl. No.: 219,284

[22] Filed: Dec. 22, 1980

[30] Foreign Application Priority Data

Dec. 21, 1979 [DE] Fed. Rep. of Germany ..... 2951611

[51] Int. Cl.[4] ..... B65B 31/02; B43K 7/10

[52] U.S. Cl. ..... 141/1; 118/50; 141/4; 141/20.5; 401/190; 401/176

[58] Field of Search ..... 401/187, 188, 190, 17–21, 401/109–114, 29–33, 132, 133, 135, 191, 196, 198, 199, 207, 202, 209, 213, 214, 216, 217; 118/50; 141/1, 4, 18, 20.5, 110, 375, 378

[56] References Cited

U.S. PATENT DOCUMENTS

| | | | |
|---|---|---|---|
| 722,505 | 3/1903 | Hanson | 118/50 |
| 744,750 | 11/1903 | Green | 118/50 |
| 2,519,341 | 8/1950 | Barstow | 401/209 |
| 2,938,499 | 5/1960 | Lindenbaum | 141/20.5 |
| 3,094,152 | 6/1963 | Kenny | 401/190 |
| 3,115,868 | 12/1963 | DeMolin | 401/209 |
| 3,282,306 | 11/1966 | Greenhut | 118/50 |
| 3,286,741 | 11/1966 | Gellman | 141/18 |
| 3,799,218 | 3/1974 | Douglass | 141/18 |
| 3,850,136 | 11/1974 | Ruzzo | 118/50 |
| 3,854,826 | 12/1974 | Adams | 401/141 |
| 3,863,686 | 2/1975 | Klein | 141/20.5 |

FOREIGN PATENT DOCUMENTS

| | | | |
|---|---|---|---|
| 265058 | 5/1963 | Australia | 401/187 |
| 58110 | 5/1953 | France | 401/141 |
| 28097 | of 1911 | United Kingdom | 401/157 |
| 2035147 | 6/1980 | United Kingdom | 401/190 |

*Primary Examiner*—Clyde I. Coughenour

*Attorney, Agent, or Firm*—Manfred M. Warren; Robert B. Chickering; Glen R. Grunewald

[57] ABSTRACT

A ball point pen cartridge capable of being pressurized in a pressure vessel including an end stopper having an enlarged section shaped to seal the end of a cartridge tube, a narrower section connected to the enlarged portion and extending into the cartridge, an axial tube running completely through the enlarged section and partly through the narrower section, a radial tube in the narrower section that intersects the axial tube and a flexible, gas impervious tube surrounding the narrower section to form a check valve with the radial tube.

1 Claim, 1 Drawing Figure

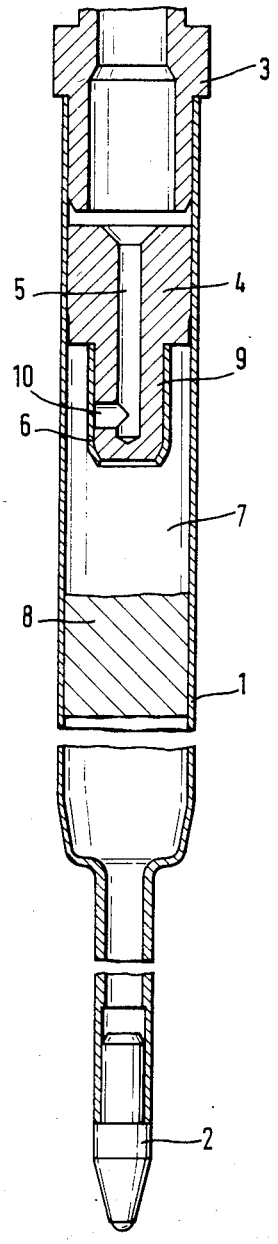
3
5
4
9
10
6
7
8
1
2

PROCESS FOR THE PRODUCTION OF A BALL POINT PEN CARTRIDGE

BACKGROUND OF THE INVENTION

The invention concerns a process for the production of a ball point pen cartridge, the ink column of which is constantly acted upon by gas pressure.

With ball point pen cartridges of this type there is the problem of creating the gas pressure in the rear part of the ink tube before the rear end of the tube is finally sealed and also to make sure that the gas pressure has the same value in the production of each cartridge and is maintained after being created. Since ball point pen cartridges are mass production articles, the production of the gas pressure must also be capable of being carried out in an economical fashion.

The familiar processes did not meet these requirements, and they were not able to guarantee uniform quality in mass production.

A familiar process consists in bringing together two chemical substances at the rear end of the ink column which react together, emitting gas, whereby the gas-emitting reaction occurred after the complete sealing of the ink tube. This process is complicated, expensive and imprecise.

Another familiar process consists in positioning a sealed capsule containing one gas in the rear, end of the ink tube and providing a stopper which has a needle, whereby the user must pierce the capsule with the needle, when putting the cartridge into use, by pushing on the stopper, in order to be able to build up the gas pressure. This process is also imprecise and relatively expensive, and besides that, the user still has to perform an operation on the cartridge.

Finally, another familiar process involves pushing a stopper into the rear end of the ink tube, whereby the air between the end of the ink column and the stopper is compressed. This process is, to be sure, relatively simple, still there are problems of sealing, and the amount of ink to be put into the ink tube is limited, because a part of the space which is needed to compress the column of air is lost as storage space for the ink.

SUMMARY OF THE INVENTION

The problem of the invention is to create a process for the production of a ball point pen cartridge, the ink column of which is constantly acted upon by gas pressure, which guarantees in a simple manner the production and maintenance of a constant gas pressure, and which also guarantees uniform quality in mass production.

The problem posed is solved by the invention by providing at the rear end of the ink tube at a distance from the end of the ink column a valve which opens into the interior of the ink tube, and by placing the cartridge as a whole into a container, in which gas pressure is produced to correspond to the gas pressure desired in the cartridge.

The process according to the invention has the advantage that production of the gas pressure may take place without any regard to constructive details of the cartridge, and that neither chemical means nor mechanical measures need be applied. It suffices to place a great quantity of the finished ball point pen cartridges into a pressure container and to subject the latter to the pressure desired in the cartridge, whereby a corresponding pressure is created in the air space between the ink column and the body of the valve in all the cartridges located in the pressure container, by means of the valve; which pressure is retained after the ball point pen cartridges are removed from the pressure container.

It is, to be sure, familiar (DE-OS No. 2 309 738) to provide ball point pen cartridges which are not under constant gas pressure with a valvelike door, by means of which, with the aid of a balloon which can be pressed in, and by more or less frequent pumping, the user can exert a certain pressure on the column of ink. This involves a different type of ball point pen cartridges, however, from that of the invention.

In a further embodiment of the invention, a ball point pen cartridge produced according to the given process has a valve element consisting of a valve stopper located in the ink tube, which shows a section turned toward the outer end of the ink tube with a diameter corresponding to the inside diameter of the ink tube and a section turned toward the ink column of smaller diameter, whereby in the axial direction of the valve stopper there is a hole running from the outer end of the valve stopper into the section of smaller diameter, whereby further there is a radial hole in the section of smaller diameter opening onto its outer circumference, which connects with the axial hole, and whereby finally an elastic sleeve is provided on the section of smaller diameter. This valve is noteworthy for its simple construction and guarantees secure sealing under even high gas pressure in the cartridge.

DETAILED DESCRIPTION OF THE INVENTION

The invention is further clarified in the following with reference to the drawing, in which a ball point pen cartridge is represented in cross section.

The ball point pen cartridge contains an ink tube 1, which is sealed at the front with the ball-shaped writing tip 2 and at the back with a stopper 3. Before the stopper 3 is put in, the ink 8 is inserted in the proper amount into the ink tube, and at a distance from the ink column a valve stopper is then inserted into the ink tube. The valve stopper contains a section 4 directed toward the outer end of the ink tube, the outside diameter of which corresponds approximately to the inside diameter of the ink tube, so that the valve stopper can be secured in the ink tube so as to seal it. Adjoining section 4 there is a section 9 on the side toward the writing tip 2, which section possesses a smaller diameter than the section 4. In the axial direction of the valve stopper runs a hole 5, which runs from the extreme end of section 4 into section 9 and ends there. In the radial direction runs through section 9 a hole 10, which connects with the axial hole 5 and together with the latter forms the entry canal for gas entering the space 7 above the ink column 8. On the cylindrical section 9 an elastic sealing sleeve 6 is tightly attached, which seals the hole 10 and thus permits entry of gas into the space 7 while preventing any return flow.

The valve stopper including its sealing sleeve is pushed into the ink tube as a prefabricated element and secured to it, whereupon the end stopper 3 is attached, which is hollow, so that the gas can reach the valve stopper unhindered. The application of the desired gas pressure to the space 7 is accomplished by putting the finished ball point pen cartridge along with a large number of other cartridges together into a container, in which gas is compressed to a pressure value corresponding to that desired in the space 7. By means of the valve stopper, the pressure in the space 7 becomes the same as that obtaining in the container, which is retained also in the space 7, when the pressure container is once again removed from high pressure.

What is claimed is:

1. Process for production of a great quantity of ball point pen cartridges, the ink columns of which are constantly acted upon by high-pressure gas, characterized by providing at the rear end of each ink tube at a distance from the end of the ink column, a valve which opens into the interior of the ink tube, placing the cartridges into a container, introducing high-pressure gas into the container at a pressure to correspond to the pressure wanted in each cartridge, then reducing the gas pressure in the chamber and removing the cartridges from the chamber.

* * * * *